US006810810B2

(12) United States Patent
Anweiler et al.

(10) Patent No.: US 6,810,810 B2
(45) Date of Patent: Nov. 2, 2004

(54) METHOD AND DEVICE FOR ADJUSTING A QUANTITY OF INK SUPPLIED TO AN IMPRESSION CYLINDER OF A PRINTING MACHINE

(75) Inventors: Werner Anweiler, Bruchsal (DE); Martin Mayer, Ladenburg (DE); Nikolaus Pfeiffer, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/016,871

(22) Filed: Dec. 14, 2001

(65) Prior Publication Data

US 2002/0073867 A1 Jun. 20, 2002

(30) Foreign Application Priority Data

Dec. 14, 2000 (DE) ..... 100 62 170

(51) Int. Cl.[7] ..... B41F 31/04
(52) U.S. Cl. ..... 101/484; 101/365; 101/DIG. 47
(58) Field of Search ..... 101/365, 484, 101/350.4, 350.3, 351.1, 351.3, 364, 367, 485, DIG. 47, DIG. 32

(56) References Cited

U.S. PATENT DOCUMENTS 2,971,461 A * 2/1961 Bradford et al. ..... 101/216
3,688,696 A * 9/1972 Treff et al. ..... 101/350.4
4,570,539 A * 2/1986 Rottstedt ..... 101/483
5,029,527 A * 7/1991 Jeschke et al. ..... 101/365
5,031,535 A * 7/1991 Kipphan et al. ..... 101/483
5,040,459 A * 8/1991 Rambausek ..... 101/217
5,170,711 A * 12/1992 Maier et al. ..... 101/365
5,224,421 A * 7/1993 Doherty ..... 101/211
5,590,599 A * 1/1997 Muller et al. ..... 101/483
5,907,999 A * 6/1999 Lusar et al. ..... 101/484
6,142,078 A * 11/2000 Lachajewski ..... 101/484

FOREIGN PATENT DOCUMENTS

| | | |
|---|---|---|
| DE | 24 45 908 | 4/1975 |
| DE | 197 01 219 A1 | 7/1998 |
| DE | 197 20 954 A1 | 12/1998 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

A method of adjusting a quantity of ink supplied to a printing material by a printing machine includes adjusting the quantity of ink as a function of the printing speed and, upon the occurrence of a change in the printing speed, making a change in the quantity of ink as a function of area coverage to be printed; and an adjusting device for performing the method.

10 Claims, 3 Drawing Sheets

METHOD AND DEVICE FOR ADJUSTING A QUANTITY OF INK SUPPLIED TO AN IMPRESSION CYLINDER OF A PRINTING MACHINE

BACKGROUND OF THE INVENTION

Field of the Invention

The invention relates to a method and a device for adjusting a quantity of ink supplied to an impression cylinder of a printing machine.

Quality demands on printed documents continue to increase, so that precise control of a printing machine for applying ink to a printing material is necessary.

Printing machines are operated at different printing speeds, depending upon the print job, so that the rotational speed of the impression cylinder changes, which has a corresponding influence upon the quantity of ink supplied to the impression cylinder.

German Patent (DE) 24 45 908 discloses an inking unit and a density regulating device for printing machines in which a precise amount of ink is applied to the printing material. Flexible measuring elements similar to plates are used for this purpose. By using zonal measuring elements, it is possible to adjust the ink flow to an appropriate value. The resulting properties of the measuring elements permit the amount of ink applied to a transfer roller and, therefore, to the printing material, to be varied during corresponding changes in the speed of movement of the printing material. In this regard, the quantity of ink supplied to the impression cylinder is regulated as a function of the printing speed.

A disadvantage of this heretoforeknown method is that, for each speed change, the individual ink setting elements have to be moved. In addition, it has become known heretofore to perform speed compensation by adjusting the length of the ink stripe.

SUMMARY OF THE INVENTION

It is accordingly an object of the invention to provide a method and device for regulating a quantity of ink supplied to an impression cylinder by which an improved regulation of the ink quantity is possible.

With the foregoing and other objects of the invention, there is provided in accordance with one aspect of the invention, a method of adjusting a quantity of ink supplied to a printing material by a printing machine, which comprises adjusting the quantity of ink as a function of the printing speed, and including, upon the occurrence of a change in the printing speed, making a change in the quantity of ink as a function of area coverage to be printed.

In accordance with another mode, the method of the invention includes changing the ink stripe length for adjusting a requisite quantity of ink.

In accordance with a further mode, the method of the invention includes storing characteristics for the ink stripe length for various area coverages as a function of the printing speed and, upon the occurrence of a change in the printing speed, varying the ink stripe length in accordance with a respective characteristic.

In accordance with an added mode, the method of the invention includes changing the quantity of ink by changing an inking zone level, the inking zone level representing the thickness of the ink with which the ink is applied to a ductor roller.

In accordance with an additional mode, the method of the invention includes differently adjusting the inking zone level for inking zones, and using a prescribed area coverage of one inking zone for controlling the quantity of ink for the inking zone.

In accordance with a concomitant aspect of the invention, there is provided a device for printing a printing material, comprising an ink duct having an ink duct roller, a pivotable ductor roller and a transfer roller, the ductor roller being bringable into contact both with the ink duct roller and the transfer roller, the transfer roller serving for transferring a quantity of ink transferrable from the ductor roller to the printing material via further rollers, a control device for adjusting a contact length of the ductor roller on the ink duct roller as a function of printing speed, the control device being connected to a memory having stored therein values for an ink stripe length as a function of the printing speed and an area coverage to be printed, the control device serving for adjusting the ink stripe length as a function of the printing speed and the area coverage.

A significant advantage of the invention is that the amount of ink to be supplied to the printing cylinder is adjusted as a function of an area coverage to be printed.

The quantity of ink is preferably adjusted over the length of the ink stripe.

In a further embodiment, the quantity of ink is adjusted by adjusting the inking zone level.

The ink level can preferably be adjusted individually for each inking zone.

In addition, it is advantageous to adjust the quantity of ink over the length of the ink stripe and the inking zone level.

Other features which are considered as characteristic for the invention are set forth in the appended claims.

Although the invention is illustrated and described herein as a method and a device for adjusting a quantity of ink supplied to an impression cylinder of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

Figure 1:
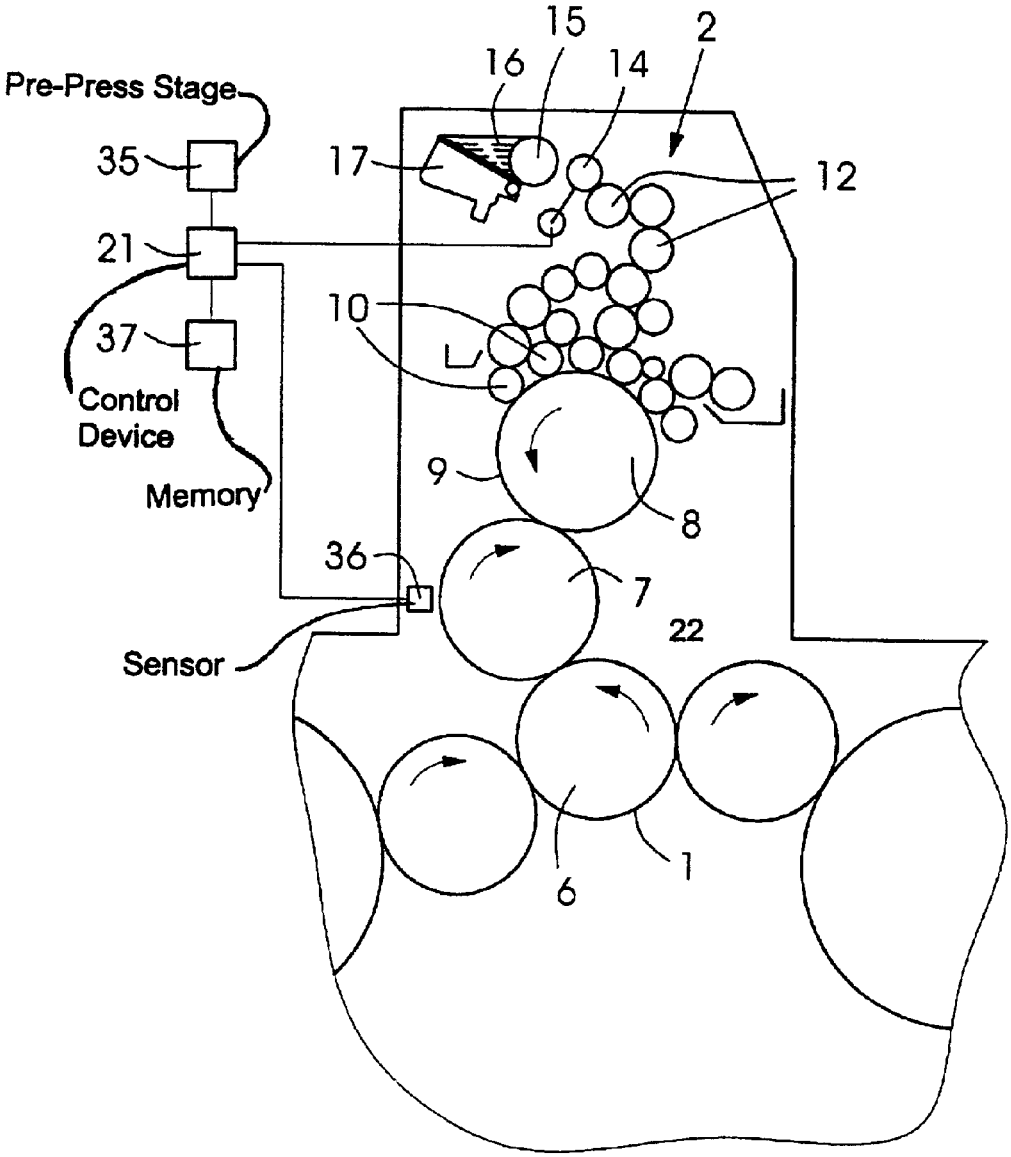
FIG. 1 is a fragmentary diagrammatic side elevational view of a printing machine with a printing unit wherein the adjusting device according to the invention is incorporated.

DESCRIPTION OF THE PREFERRED EMBODIMENTS:

Referring now to the drawings and, first, particularly to FIG. 1 thereof, there is shown therein diagrammatically a printing machine which has a printing unit 2. The printing unit 2 includes an impression cylinder 6, a transfer cylinder 7 and a printing-form cylinder 8. Fixed to the printing-form cylinder 8 is a printing form 9 having areas which accept ink and areas which repel ink in a manner corresponding to an image to be printed. Ink applicator rollers 10 are set against the printing form 9. Ink transfer rollers 12 are arranged upline from the ink applicator rollers 10, as viewed in a direction of ink transfer from a printing ink source 16. Also provided is a ductor or vibrator roller 14, which is pivotably mounted and at periodic time intervals is engageable with an ink duct roller 15 and the ink transfer roller 12. The ink duct roller 15 dips into printing ink at the source 16 thereof, which is an ink duct or fountain 17. During a printing operation, printing material 1 is transported on the impression cylinder 6 in the direction indicated by an arrow 22 and is printed by the transfer cylinder 7. A control device 21 is connected to a pre-press stage 35 and a memory 37, respectively, as well as to a sensor 36.

Figure 2:
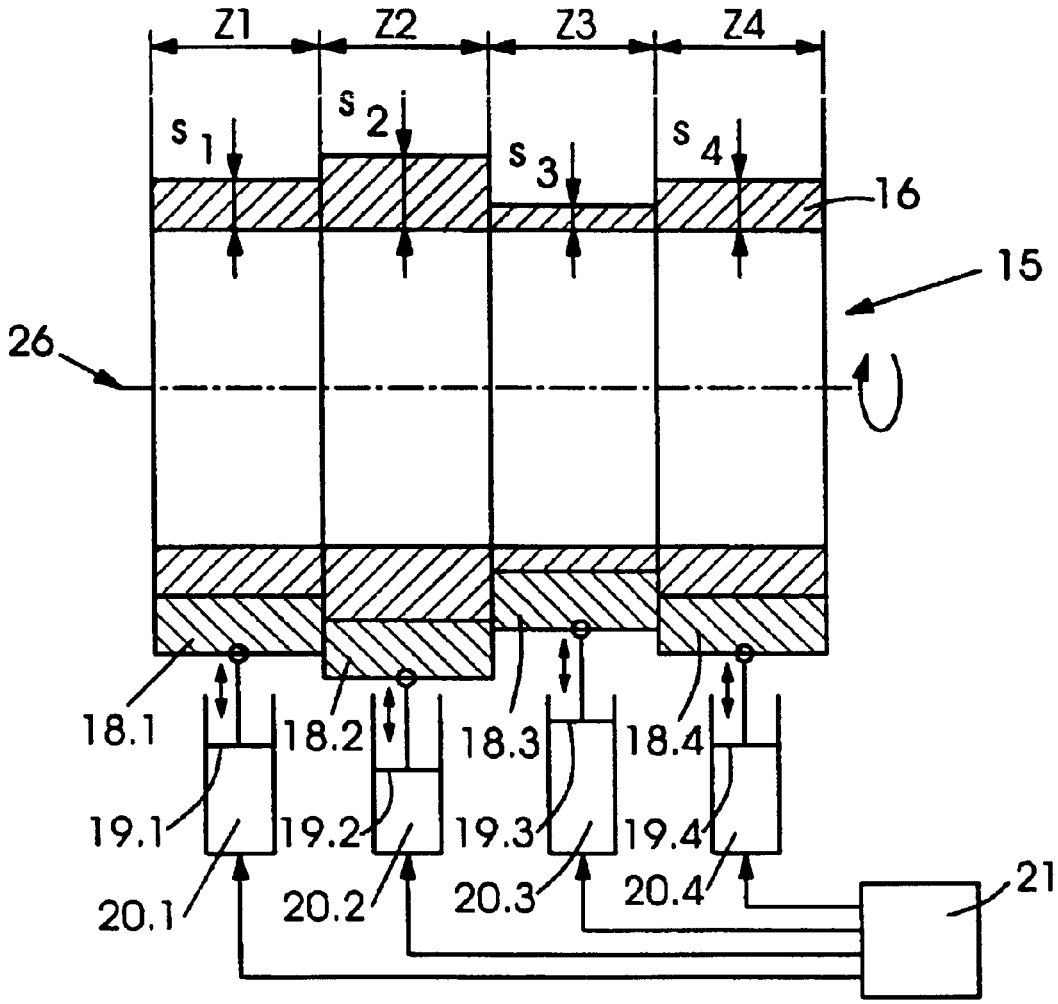
FIG. 2 is a schematic and diagrammatic sectional view of an ink metering device according to the invention.

FIG. 2 provides a more detailed view of the construction of the ink duct roller 15. On the ink duct 17, metering elements 18 are arranged so that they can be set against the ink duct roller 15. In order to set the metering elements 18 on and off, i.e., so that they engage and disengage from the ink duct roller 15, they are coupled to an adjusting device 19, 20. The adjusting devices 19 and 20 are connected to the control device 21.

Four metering elements 18.1 to 18.4 are assigned to the ink duct roller 15 without gaps, and extend parallel to an axis 26. The metering elements 18.1 to 18.4 are coupled to pistons 19.1 to 19.4 which cooperate with operating cylinders 20.1 to 20.4. The operating cylinders 20.1 to 20.4, respectively, can have pressure medium applied separately thereto, the pressure medium being controlled by the control device 21. Depending upon the ink demand in a respective zone Z1 to Z4, the metering elements 18.1 to 18.4 are adjusted to different distances or spacings from the outer cylindrical surface of the ink duct roller 15. As the ink duct roller 15 rotates in the ink duct 17, an ink profile having layer thicknesses S1 to S4 is formed on the outer cylindrical surface of the ink duct roller 15, in the respective zones Z1 to Z4. Depending upon the cycle rate and the contact times of the ductor roller 14, the respective ink profile is applied to the printing form 9 with the aid of the ink transfer rollers 12 and the ink applicator rollers 10. Depending upon the length of time the ductor roller 14 engages the ink duct roller 15, an ink stripe of corresponding length is transferred from the ink duct roller 15 to the ductor roller 14. The length of the section over which the ductor roller 14 rolls on the ink duct roller 15 therefore defines the length of the ink stripe and, consequently, the amount of ink transferred. In addition, the amount of ink transferred is determined by the ink level S1, S2, S3, S4 in the respective inking zones Z1, Z2, Z3 and Z4.

Ink-accepting areas of the printing form 9 are inked. The printing image inked on the printing form 9 is transferred to the transfer cylinder 7 and printed onto the printing material 1 by the transfer cylinder 7.

Figure 3:
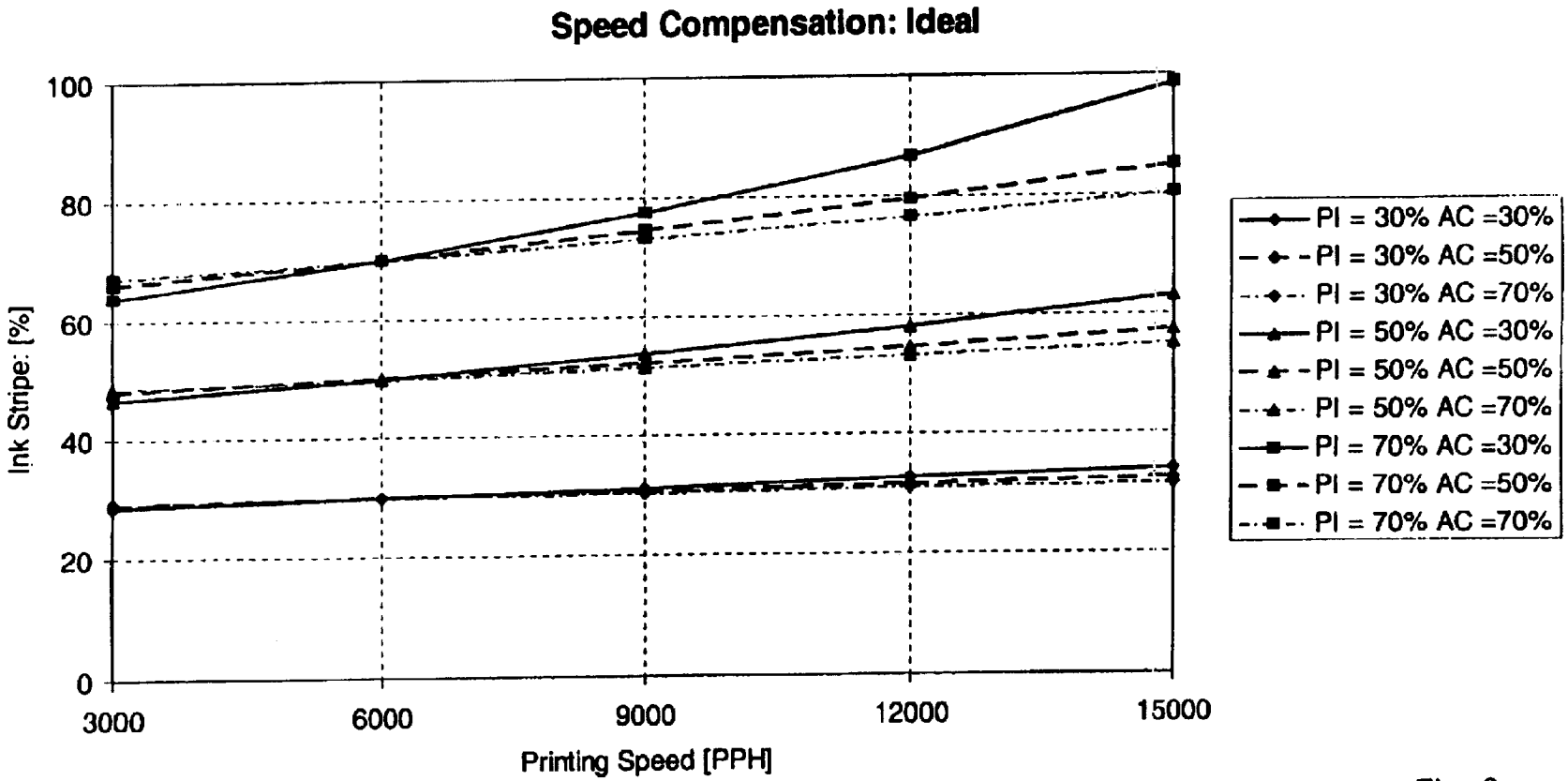
FIG. 3 is a plot diagram or graph illustrating control characteristics for adjusting ink stripe length as a function of printing speed and mean area coverage over all zones into which a printing image has been divided.

FIG. 3 is a plot diagram or graph showing control characteristics for adjusting ink stripe length as a function of printing speed and mean area coverage over all zones of a printing image. In the graph of FIG. 3, the length of the ink stripe is represented in the form of a percentage statement, 100% corresponding to the maximum length of the ink stripe.

The characteristics illustrated in the graph are stored in the memory 37 which is connected to the control device 21. In addition, the sensor 36 connected to the control device 21 registers the speed of the printing material 1 and the speed of the transfer cylinder 7, respectively, and receives, accordingly, a measured signal for the printing speed of the printing unit. If, for example, an ink stripe of 70% is prescribed or predefined, and the printing speed changes from 6,000 printed sheets per hour (PPH) to 12,000 PPH, then, depending upon the mean area coverage (AC), the prescribed ink stripe (PI) is increased to about 90% if the area coverage is 30%, in order to apply the same amount of ink to the printing material 1 as that at a printing speed of 6,000 PPH.

In the case of a prescribed ink stripe (PI) of 70%, however, if the printing speed changes from 6,000 PPH to 12,000 PPH with a mean area coverage (AC) of 70%, the ink stripe will then be increased by the control unit 21 only to about 78% in order to apply the same quantity of ink to the printing material 1 as that at a printing speed of 6,000 PPH.

Thus, a variation in the ink stripe occurs as a function of the printing speed and of the defined or prescribed mean area coverage.

In FIG. 3, only some characteristic lines are shown for the ink stripes of 30%, 50% and 70%, depending upon the printing speed and the mean area coverage (AC). Preferably stored in the memory 37 is a characteristic map which is dependent upon the printing speed of the ink stripe length to be corrected for any desired ink stripe lengths and any desired mean area coverages. Thus, in the event of a change in the printing speed, taking the given area coverage into account, the control device 21 is able to determine the ink stripe length to be corrected from the characteristic map and to drive the ductor roller 14 in such a manner that a lengthened or shortened ink stripe length is produced. To this end, the ductor roller 14 is placed on the ink duct roller 15 over a longer or a shorter length.

In addition, the amount of ink can be changed as a function of the printing speed and the area coverage by changing the ink level. For this purpose, the metering elements 18 are driven in accordance with the values of stored characteristics.

Stored in the characteristics are values for driving the metering elements as a function of the printing speed and the mean area coverage, those values being determined experimentally for a predefined ink thickness on the printing material.

The characteristic map stored in the memory 37 is preferably additionally dependent upon the temperature of the ink to be applied, the tackiness of the ink to be applied, the viscosity of the ink to be applied and the printing properties of the printing material 1 used. The method according to the invention is made more precise by taking into account the mean area coverage of each individual zone for controlling the ink stripe of the printing unit.

In a preferred embodiment, the ink stripe length is assigned directly to a mean area coverage. In this case, the three-dimensional characteristic map can be reduced by one dimension, because one ink stripe length is determined for each printing speed as a function of the prescribed or predefined mean area coverage.

The characteristic map set up also takes into account the machine temperature, the paper properties (coated, uncoated), the inking level (full-tone density), and the Theological properties of the inks (viscosity and tackiness).

A printing image is divided up into inking zones, which represent rectangular areas. For each inking zone, the ink thickness which is transferred from the ink duct to the ductor roller can be adjusted individually. The ink thickness is also referred to as the inking zone opening. For each inking zone, the area coverage, which represents the area of the inking zone wherein ink is transferred to the printing material, is prescribed or predefined. In a simple embodiment, an area coverage averaged over all the inking zones is used to control the amount of ink in all the inking zones.

A further embodiment uses, for each inking zone, the used area coverage of the inking zone with which the quantity of ink in the inking zone is adjusted individually. The adjustment of the quantity of ink in an individual inking zone is defined or determined over or via the ink thickness, which is transferred to the ductor roller for the inking zone.

We claim:

1. A method of adjusting a quantity of ink supplied to a printing material by a printing machine with inking zones, which comprises:

adjusting a quantity of ink as a function of a printing speed, and including, upon the occurrence of a change in the printing speed, making a change in the quantity of ink as a function of an area coverage to be printed averaged over several of the inking zones.

2. The method according to claim 1, which includes: changing an ink stripe length for adjusting a requisite quantity of ink.

3. The method according to claim 2, which includes: storing characteristics for the ink stripe length for various area coverages as a function of the printing speed and, upon the occurrence of a change in the printing speed, varying the ink stripe length in accordance with a respective characteristic.

4. The method according to claim 1, which includes making a change in the quantity of ink as a function of the printing speed and a property of the ink.

5. The method according to claim 1, which includes making a change in the quantity of ink as a function of the printing speed and a paper property.

6. The method according to claim 1, which includes making a change in the quantity of ink as a function of an area coverage to be printed averaged over all inking zones.

7. The method according to claim 1, which includes changing the quantity of ink by changing an inking zone level representing the thickness of the ink with which the ink is applied to a ductor roller.

8. The method according to claim 1, which includes making a change in the quantity of ink as a function of the printing speed and a temperature.

9. A device for printing a printing material with inking zones, comprising:

an ink duct having an ink duct roller, a pivotable ductor roller and a transfer roller, said ductor roller to be brought into contact both with said ink duct roller and said transfer roller, said transfer roller serving for transferring a quantity of ink transferrable from said ductor roller to the printing material via further rollers; and a control device for adjusting a contact length of said ductor roller on said ink duct roller as a function of printing speed, said control device being connected to a memory having stored therein values for an ink stripe length as a function of the printing speed and an area coverage to be printed averaged over several of the inking zones, said control device serving for adjusting the ink stripe length as a function of the printing speed and the area coverage to be printed averaged over several of the inking zones.

10. The device according to claim 9, wherein said control device serves for adjusting the ink stripe length as a function of the printing speed and the area coverage to be printed averaged over all inking zones.

* * * * *